US009314984B2

(12) United States Patent
Hejplik et al.

(10) Patent No.: US 9,314,984 B2
(45) Date of Patent: Apr. 19, 2016

(54) FORMING PRESS

(71) Applicant: Uniflex Hydraulik GmbH, Karben (DE)

(72) Inventors: Vaclav Hejplik, Dietzenbach (DE); Patrick Sticker, Bad Vilbel-Dortelweil (DE); Carsten Baumgartner, Laubach (DE)

(73) Assignee: UNIFLEX HYDRAULIK GMBH, Karben (DE)

( * ) Notice: Subject to any disclaimer, the term of this patent is extended or adjusted under 35 U.S.C. 154(b) by 0 days.

(21) Appl. No.: 14/744,994

(22) Filed: Jun. 19, 2015

(65) Prior Publication Data

US 2015/0283775 A1 Oct. 8, 2015

Related U.S. Application Data

(63) Continuation of application No. PCT/EP2013/003887, filed on Dec. 20, 2013.

(30) Foreign Application Priority Data

Dec. 21, 2012 (DE) ..... 10 2012 025 134

(51) Int. Cl.
*B30B 1/32* (2006.01)
*B30B 15/16* (2006.01)
(Continued)

(52) U.S. Cl.
CPC ..... *B30B 1/323* (2013.01); *B21D 39/048* (2013.01); *B25B 27/10* (2013.01); *B30B 7/04* (2013.01); *B30B 15/161* (2013.01)

(58) Field of Classification Search
CPC ..... B30B 1/323; B30B 15/161; B30B 7/04; B30B 1/32; B21D 39/048; B21D 39/04; B25B 27/10; Y10T 29/5367; Y10T 29/49927
USPC ..... 100/43, 50, 219, 231, 244, 264, 269.01, 100/269.03, 269.09, 269.14; 72/402; 29/508, 237, 516
See application file for complete search history.

(56) References Cited

U.S. PATENT DOCUMENTS 3,451,249 A * 6/1969 Sharon ..... B21J 9/12 72/402
4,854,031 A 8/1989 Eisenzimmer
(Continued)

FOREIGN PATENT DOCUMENTS

DE 4135465 A1 4/1993
DE 19912976 A1 9/2000
(Continued)

OTHER PUBLICATIONS

International Search Report with Written Opinion, mailed Apr. 24, 2014, for corresponding International Application No. PCT/EP2013/003887.

*Primary Examiner* — Jimmy T Nguyen
(74) *Attorney, Agent, or Firm* — Myers Wolin, LLC

(57) ABSTRACT

A fluidic forming press is provided, comprising a frame structure, a movable first tool carrier, a movable second tool carrier, a drive system, and a press controller that controls the drive system. A first drive unit associated with the first tool carrier is designed as a fast-stroke unit, the first tool carrier can be mechanically locked in the closed position thereof in relation to the frame structure by means of at least one position-changeable locking body, at least one piston-cylinder unit associated with the second tool carrier is designed as a high-pressure unit at least for part of the motion of the second tool carrier in the direction of the first tool carrier, and a fluidic pressure booster is integrated into a feed line that connects the high-pressure unit to the associated pressure fluid unit.

25 Claims, 14 Drawing Sheets

(51) Int. Cl.

| | |
|---|---|
| ***B30B 7/04*** | (2006.01) |
| ***B21D 39/04*** | (2006.01) |
| ***B25B 27/10*** | (2006.01) |

(56) References Cited

U.S. PATENT DOCUMENTS

| | | | | |
|---|---|---|---|---|
| 5,823,104 | A * | 10/1998 | Beisel | B30B 1/32 100/218 |
| 6,240,818 | B1 * | 6/2001 | Baltschun | B21D 28/16 83/137 |
| 2002/0056307 | A1 * | 5/2002 | Ertl | B21D 39/048 72/402 |
| 2005/0061052 | A1 * | 3/2005 | Schrock | B21D 39/048 72/402 |
| 2009/0084277 | A1 * | 4/2009 | Yanagimoto | B30B 1/323 100/269.05 |

FOREIGN PATENT DOCUMENTS

| | | | |
|---|---|---|---|
| DE | 19940744 | A1 | 3/2001 |
| DE | 102004035590 | A1 | 3/2006 |
| DE | 102005034260 | B3 | 7/2006 |
| DE | 102009017624 | A1 | 10/2010 |
| DE | 102009057726 | A1 | 6/2011 |

* cited by examiner

FORMING PRESS

CROSS REFERENCE TO RELATED APPLICATIONS

This application is a continuation under 35 U.S.C. §120 of International Application PCT/EP2013/003887, filed Dec. 20, 2013, which claims priority to German Application 10 2012 025 134.3, filed Dec. 21, 2012, the contents of each of which are incorporated by reference herein.

FIELD OF THE INVENTION

The present invention relates to a fluidic forming press, especially a radial press, with two die carriers capable of moving relative to one another along a working direction.

BACKGROUND

Such presses used for forming of workpieces are known in various embodiments. They differ from one another, for example, with respect to their intended use (e.g. radial press) and the related construction (e.g. yoke press) as well as the drive concept (e.g. hydraulic). Hydraulically driven yoke presses for radial deformation of workpieces are known, for example, from DE 19912976 A1, DE 102009057726 A1, DE 4135465 A1 and U.S. Pat. No. 4,854,031 A.

DE 102004035590 A1 discloses a forming press, which has a main ram that can be moved up and down and can be interlocked after the closing stroke with a fixed part of the press (especially the lower crosshead), and in which a ram that executes the working stroke for forming the workpiece as well as a sheet holder (together with associated drive cylinder) are received.

The need exists in industry for increasingly powerful forming presses, i.e. forming presses with substantially greater press force compared with the established prior art. In the special case of radial presses, this need also relates among other aspects to the knowledge that, by radial deformation of a workpiece—or possibly the mutual forming of two workpieces to be joined to one another—in a radial forming press, it is possible to manufacture high-strength joints, and so entirely new areas of application (especially in joining engineering) can be opened up.

SUMMARY

The object of the present invention is to provide a fluidic forming press that is particularly efficient in the sense of exerting extremely high press forces, especially a particularly powerful radial press for radial forming of workpieces having relatively large dimensions.

This object is achieved by the fluidic forming press specified in the claims. Thus the inventive forming press, which in particular can be constructed as a radial press, is characterized by the following features in combination and synergistic interaction with one another: The fluidic forming press comprises a frame structure, a first die carrier capable of moving relative to the frame structure along a working direction, a second die carrier capable of moving relative to the frame structure along the working direction, a drive system acting on the first and second die carriers and a press controller that controls the drive system, wherein the drive system comprises a first drive unit associated with the first die carrier and a second drive unit associated with the second die carrier with at least one fluidic cylinder-piston unit, at least one pressurized-fluid assembly pressurizing at least the latter and preferably valves actuated by the press controller and controlling the pressurization. The at least one first drive unit associated with the first die carrier is constructed as a fast-stroke unit, by means of which the first die carrier can be moved between a home position relatively distant from the second die carrier and a closed position relatively close to the second die carrier, i.e. the die can be opened or closed around the workpiece. In its closed—relative to the second die carrier—position, the first die carrier can be mechanically interlocked relative to the frame structure by means of at least one positionally variable interlocking member. At least one fluidic piston-cylinder unit associated with the second die carrier is constructed as a unit that can exert high pressure at least for part of the movement of the second die carrier toward the (interlocked) first die carrier, namely for the actual press action following precompression (see hereinafter), and that can be operated at an operating pressure substantially greater than the working pressure of the associated pressurized-fluid assembly. For this purpose, (at least) one fluidic pressure booster is integrated into the feed line via which the high-pressure unit is in communication with the associated pressurized-fluid assembly. This booster can be understood as a component within which the pressure prevailing in the working fluid is raised from a first level to a second, higher level. This takes place ideally without input of external energy, especially by pressure boosting in inverse ratio of the face sizes of a stepped piston on the low-pressure and high-pressure sides.

The explanation hereinafter of the present invention is provided solely in the interests of a better understanding of a preferred embodiment, in which the drive system is hydraulically constructed, wherein both the first and second drive units comprise hydraulic piston-cylinder units, the at least one pressurized-fluid assembly is constructed as a hydraulic assembly, a hydraulic pressure booster is provided and the at least one first hydraulic piston-cylinder unit associated with the first die carrier is constructed as a low-pressure unit that can be operated at most with the feed pressure of the associated hydraulic assembly. However, the explanation of the invention focused on this embodiment cannot be construed as limiting the invention in any way to the configuration in question, even if this further development is referred to as the "inventive" forming press. In particular, within the scope of the present invention specified by the claims, for example, any other embodiment of the first drive unit (e.g. as an electric spindle drive) is also conceivable.

The preferred embodiment of the inventive radial or other forming presses explained in more detail hereinafter are therefore characterized by the following features in combination and synergistic interaction with one another: The hydraulic forming press comprises a frame structure, a first die carrier capable of moving relative to the frame structure along a working direction, a second die carrier capable of moving relative to the frame structure along the working direction, a hydraulic drive system acting on the first and second die carriers and a press controller that controls the hydraulic drive system, wherein the hydraulic drive system comprises hydraulic piston-cylinder units associated with the individual die carriers, at least one hydraulic assembly pressurizing this and preferably valves actuated by a press controller and controlling the pressurization. The at least one first hydraulic piston-cylinder unit associated with the first die carrier is constructed as a low-pressure unit that can be operated at most with the feed pressure of the associated hydraulic assembly, by means of which the first die carrier (typically in "rapid traverse") can be moved between a home position relatively distant from the second die carrier and a closed position relatively close to the second die carrier. In its closed position, the first die carrier can be mechanically interlocked relative to the frame structure by means of at least one positionally variable interlocking member. The at least one second hydraulic piston-cylinder unit associated with the second die carrier is constructed as a unit that can exert high pressure at least for part of the movement of the second die carrier toward the (interlocked) first die carrier, which means that it can be operated at an operating pressure substantially greater than the feed pressure of the associated hydraulic assembly. For this purpose, (at least) one hydraulic pressure booster is integrated into the feed line via which the high-pressure unit is in communication with the associated hydraulic assembly.

By the fact that both the first and the second die carriers are capable of moving relative to the frame structure along the working direction in the inventive hydraulic forming press, the space for receiving the workpiece to be formed can be opened relatively widely. This is an essential aspect, for example in such applications in which a complex workpiece must be inserted into the space available for receiving the workpiece between the two die carriers (or between the component dies used therein). Even for radial presses that can be loaded from the side (see hereinafter), a correspondingly large stroke is essential for making the free space ready to permit insertion of the workpiece from the side between the two die carriers. In conjunction with the further features characteristic of the inventive hydraulic forming press, such a larger stroke of the two die carriers relative to one another, in contrast to that typically available in the established prior art, does not entail a restriction with respect to the maximum press force. To the contrary: The inventive hydraulic forming press can apply much higher press forces than achieved heretofore. A major contribution to this comes from the fact that a hydraulic pressure booster disposed in the associated feed line is associated with the second hydraulic piston-cylinder unit associated with the at least one second die carrier, thus allowing it to be constructed as a high-pressure unit, the operating pressure of which lies substantially, typically by a multiple, above the feed pressure of the associated hydraulic assembly and the operating pressure of the at least one first hydraulic piston-cylinder unit associated with the first die carrier. In this situation, to ensure that the at least one first hydraulic piston-cylinder unit, which is essentially used for rapid closing (and opening) of the press in the sense of a "no-load stroke" or "rapid traverse", is not subjected to the correspondingly high full press force, the mechanical positive interlocking of the first die carrier relative to the frame structure by means of at least one positionally variable interlocking member is provided as already explained hereinabove.

By the fact that the second die carrier for power pressing can be pressurized via a hydraulic pressure booster, the high hydraulic pressure necessary—in the interests of a particularly compact construction of the forming press—for the high press forces that are needed in view of the small cross sections of the second piston-cylinder unit does not have to be provided by the hydraulic assembly itself. Accordingly, each hydraulic assembly used for pressurization of the at least one piston-cylinder unit associated with the first die carrier can also be used for pressurization (which in any case takes place indirectly in phases via the pressure booster) of the high-pressure unit, so that, as a result, the inventive forming press can operate successfully with a single hydraulic assembly. This permits a relatively simple construction of the drive system itself together with, as explained, the highest performance data of the inventive forming press.

The statement that the first drive unit is associated with the first die carrier certainly does not mean that the first drive unit absolutely has to act between the first die carrier and the frame structure. To the contrary: It is particularly preferable, as will be explained in more detail hereinafter, for the first drive unit to act between the first and the second die carriers, so that the two die carriers form one die-carrier unit (that can be exchanged as a whole), which is joined via the first drive unit and to which a guide console is also preferably assigned, in order to ensure guidance of the two die carriers relative to one another along the working direction.

Further advantages and favorable aspects of the present invention will become clear from the explanation hereinafter of particularly favorable design features as well as the subsequent explanation of a particularly preferred exemplary embodiment illustrated in the drawing.

A further development of the inventive forming press is characterized in that the cylinder of the at least one high-pressure unit is constructed in a frame component, which forms one part of the frame structure and engages via lateral profilings in corresponding profilings of two side plates, which also belong to the frame structure. This leads to the possibility of a particularly compact construction, which in turn is favorable with respect to the extremely high operating forces, because hereby deformations of the forming press during press action can be optimally controlled. In addition, because of the load-bearing positive meshing of frame component and side plates, bolted joints subjected to load, i.e. oriented in working direction of the forming press, can be largely or possibly even completely avoided; and in addition to a very favorable force-flow pattern, the possibility of particularly simple mounting is achieved. Together with the side plates, the lateral profilings—which permit positive locking—meshing with one another and corresponding at least partly to one another in that frame component in which the cylinder of the at least one high-pressure unit is constructed then comprise particularly preferably, in addition to respectively at least one load surface oriented substantially perpendicular to the working direction, at least one bracing face offset therefrom. Thus that bracing face can in particular be oriented more or less at right angles to the respective load surface; its function consists primarily in absorbing or bracing torques induced in the side plates by the introduction of forces via the load surfaces and possibly further even in holding the side plates and the said frame component in such engagement relative to one another that the load surfaces of side plates and frame component bear securely and continuously on one another in force-transmitting relationship. The profilings of frame component and side plates corresponding to one another are preferably but not necessarily constructed as positive profiles (projections) on the frame component and negative profiles (recesses) on the side plates. The respective profile may then extend steadily over the entire depth (across the working direction) in the sense of optimal force-flow characteristics. In cross section, the profilings run adjacent to the load surfaces, preferably at least over a substantial part of an ellipse, which in turn is favorable with respect to the force-flow characteristic.

In this situation, the largest possible degree of compactness can then be achieved when—according to another further development—the hydraulic pressure booster is also integrated structurally into the frame structure in such a way that its cylinder is constructed in the same frame component as the cylinder of the at least one high-pressure unit. The advantages explained in the foregoing can be achieved particularly noticeably in this case. In addition, the entire high-pressure range in this case is "encapsulated" in a single component, so that, in particular, (exposed) line joints subjected to the highest pressures can be avoided; and in this case only the shortest ducts are needed for the passage of hydraulic fluid from the pressure booster to the at least one high-pressure unit, which is also particularly favorable because the inventive forming press typically operates—on the high-pressure side—in a pressure range in which hydraulic oil becomes compressible. A minimum pressurized-oil volume therefore has considerable advantages with respect to the hydraulic stiffness of the drive system. It is also advantageous from the viewpoints of a particularly compact construction when the hydraulic pressure booster is oriented with an axis perpendicular to the working direction of the forming press.

The aspects explained hereinabove in connection with the positive locking between the side plates of the frame structure and that frame component in which the cylinder of the at least one high-pressure unit is constructed are valid correspondingly for the at least one interlocking member, on which the first die carrier is braced during power pressing. This means that preferably the at least one interlocking member engages positively at least in its interlocked position via lateral profilings in corresponding profilings of two side plates belonging to the frame structure. Particularly preferably, these profilings of the at least one interlocking member and each of the two side plates respectively bear against one another at least at one load surface oriented substantially perpendicular to the working direction. Additional bracing of the at least one interlocking member in the region of a bracing face (e.g. on the first die carrier) disposed in substantially perpendicular direction on the load surface and offset therefrom counteracts torques induced by axially offset introduction of force. Once again, the profilings of interlocking member(s) and side plates corresponding to one another are preferably constructed as positive profiles (projections) on the interlocking member(s) and as negative profiles (recesses) on the side plates, and in the cross section run adjacent to the load surfaces, preferably at least over a substantial part of an ellipse.

Furthermore, it is particularly favorable when the at least one interlocking member is capable of being displaced in a direction of movement perpendicular to the working direction. In this way the press force exerted on the at least one interlocking member via the workpiece and the first die carrier during power pressing does not result in a displacement component, and so the fixation of the interlocking member in its interlocked position can be achieved with relatively little effort.

According to yet another further development of the present invention, two interlocking members mechanically coupled to one another and maintaining a distance relative to one another are provided, wherein a guide console for the first die carrier is particularly preferably provided in the space between the two interlocking members. This is also once again a viewpoint of engineering construction that permits a particularly compact structure with the advantages explained hereinabove. The said guide console is preferably joined firmly to the second die carrier.

Yet another further development of the invention is characterized in that, in addition to that feed line via which the high-pressure unit is in communication with the hydraulic pressure booster, a further feed line is provided via which the high-pressure unit can be pressurized from an associated hydraulic assembly while bypassing the hydraulic pressure booster. This makes it possible, after the first die carrier has been blocked in the position predetermined by the at least one interlocking member, firstly to pressurize the second die carrier from the said hydraulic assembly directly, i.e. while bypassing the hydraulic pressure booster, until the die comes to bear on the workpiece, namely for "precompression". In this way the complete stroke of the hydraulic booster is available for the actual press action, i.e. power pressing, and so a maximum press-action stroke is preserved for power pressing. Particularly preferably, the drive system is then provided on the supply side associated with the second die carrier with a pressure sensor in communication with the press controller, wherein a changeover that depends on the pressure signal, from (direct) pressurization of the high-pressure unit via the second feed line to pressurization of the high-pressure unit via the pressure booster, takes place during the movement of the second die carrier toward the first die carrier.

If a further feed line used for pressurizing the high-pressure unit while bypassing the hydraulic pressure booster is provided in the sense explained in the foregoing, a filling valve with a shutoff function resistant to high pressure is particularly preferably provided therein. The said shutoff function resistant to high pressure is achieved particularly preferably via a poppet valve, wherein the closing member of the poppet valve can in particular be actuated hydraulically, by the fact that it is in communication with an actuating piston, which in turn is part of a hydraulic piston-cylinder unit mounted in the housing of the filling valve. By means of the latter, the closing member can therefore be actuated, in the most favorable case both in closing direction and in opening direction of the filling valve. The filling valve explained in the foregoing, provided with a shutoff function resistant to high pressure, is then provided in yet another further development with a valve housing attached to the frame structure of the forming press, wherein preloaded expansion bolts are provided for fastening the valve housing and sealing of the valve housing against the frame structure within the range of compensation for play is achieved by means of a radial seal. This makes allowance for the fact that, under the extremely high pressures to which the inventive forming press is exposed, relative movements of the valve housing and frame structure can be expected because of deformations, wherein such movements of the valve housing relative to the frame structure are compensated for in the case of the explained sealing by means of a radial seal in the range of compensation for play, such that reliable leak-tightness is assured even at the extreme pressures (e.g. 3000 bar) prevailing on the high-pressure side.

According to yet another further development of the present invention, the at least one high-pressure unit is constructed as a single-acting unit, in the sense that only the movement of the second die carrier toward the first die carrier (from the closed position to the press-action position) during precompression and during power pressing takes place via it, but not the return from the press-action position to the closed position. For the latter, i.e. for the movement of the second die carrier away from the first die carrier, a further hydraulic piston-cylinder unit, constructed as a low-pressure unit, is provided. Such a separation of the precompression/power-pressing function on the one hand and return movement on the other hand once again permits, by virtue of the function-specific design of the components, a particularly compact construction with the advantages already explained hereinabove. Particularly preferably, two high-pressure units are provided in this case on sides of the second die carrier and the low-pressure unit—which brings about the return movement—is disposed between them. With this construction, not only is a high degree of tipping stability achieved for the second die carrier, so that tilting movements capable of impairing the function are prevented, but also, by virtue of such an arrangement of two high-pressure units spaced apart from one another, the press force is directed into the second die carrier in a manner optimal for the subsequent flow of force within the second die carrier. In this way the stresses within the second die carrier are minimized, and so this can be made with relatively small dimensions.

In a different approach, as explained in the foregoing, and as is the case for the at least one high-pressure unit associated with the second die carrier, the at least one first hydraulic piston-cylinder unit is constructed particularly preferably as a double-acting unit, so that therewith the first die carrier can be moved equally—in the sense of closing of the forming press—toward the second die carrier and also—in the sense of opening of the forming press—away from the second die carrier.

The foregoing explanation of the inventive forming press and the description hereinafter of a preferred exemplary embodiment impressively elucidate the extensive advantages associated with the present invention, i.e. that can be achieved with the forming presses defined in the claims, specifically as regards the special capability of a radial press constructed according to the present invention. This is achieved by the synergistic interactions of the cooperating features that are characteristic of the inventive forming press. For applications in which not the entire power potential inherent in the present invention is needed or exhausted, even the somewhat "scaled-down" implementation of the knowledge on which the invention is based still offers decisive advantages compared with the prior art. In the case of a reduced power demand, for example, it is possible to use embodiments of forming presses, especially of radial presses, in which—with otherwise unchanged construction—there is no need for the fluidic pressure booster associated with the second drive unit. This is the case in particular when the aspect of compactness of the forming press is of relatively little importance in the specific application in question, so that the cross sections of the second drive unit can be enlarged without seriously impairing the usability of the forming press for the application in question.

BRIEF DESCRIPTION OF THE DRAWINGS

The present invention will be explained in more detail hereinafter on the basis of a preferred exemplary embodiment illustrated in the drawing, wherein.

DETAILED DESCRIPTION OF THE PREFERRED EMBODIMENTS

Figure 1:
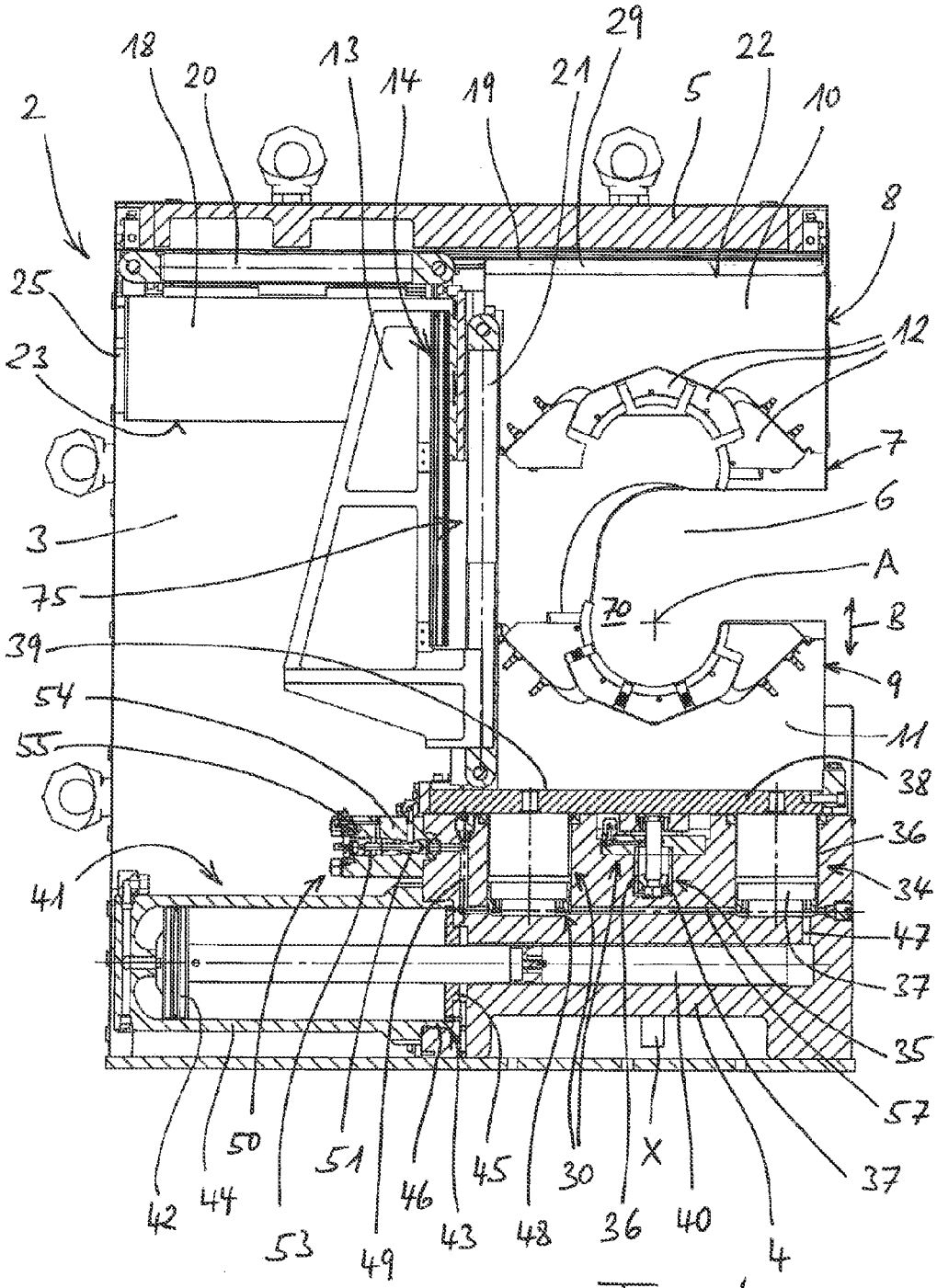
FIG. 1 shows a vertical section perpendicular to the press axis through a radial press constructed according to the present invention in its home position.

The hydraulic radial press illustrated in FIGS. 1 to 12 is used for radial deformation of a workpiece 1 relative to a press axis A. It comprises a frame structure 2, which is composed substantially of four main components, namely two side plates 3, one lower frame component 4 and one upper clamp 5. Openings 6 disposed in side plates 3 around press axis A extend as far as rim 7 of side plates 3 illustrated at the right of the drawing, in order to enable loading of the radial press from the side; this explains the designation of this radial-press design (see DE 19940744 A1) as a "C press".

Two die carriers, namely an upper, first die carrier 8 and a lower, second die carrier 9 are received between the two side plates 3 of frame structure 2 in such a way that they can be moved relative thereto as well as to one another along a working direction B, which is perpendicular to press axis A. In the present press construction, first die carrier 8 forms an upper yoke 10 and second die carrier forms a lower yoke 11. The die received in upper yoke 10 and lower yoke 11 comprises in total eight press jaws 12, which are braced in the manner known as such—in partly sliding relationship—against upper yoke 10 and lower yoke 11, wherein two of the press jaws are of split construction in the known manner. Guidance of upper yoke 10 is provided by a guide console 13, which is received between side plates 3 of frame structure 2 and joined firmly to lower yoke 11, and on which upper yoke 10 is guided slidingly and displaceably up and down by means of a linear guide 14. The components of linear guide 14 associated with upper yoke 10 are joined to upper yoke 10 not rigidly but instead via an interposed decoupling unit comprising an elastomeric member. In this way, deformations occurring—within certain limits—during operation do not impair the functional safety of the press.

Figure 11:
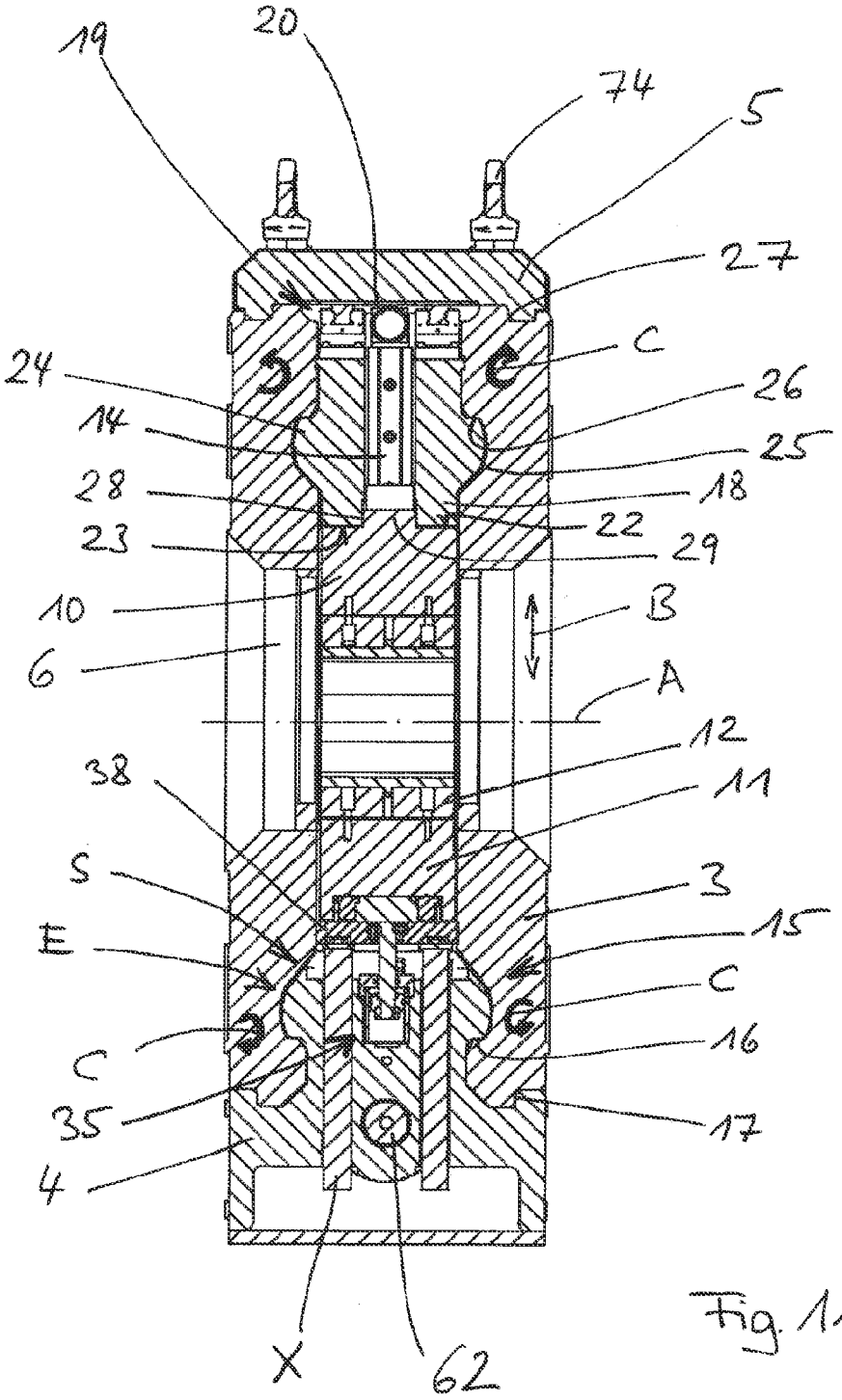
FIG. 11 shows a largely schematic vertical section in the plane of the press axis through a radial press constructed in principle according to FIGS. 1 to 10.
Figure 12:
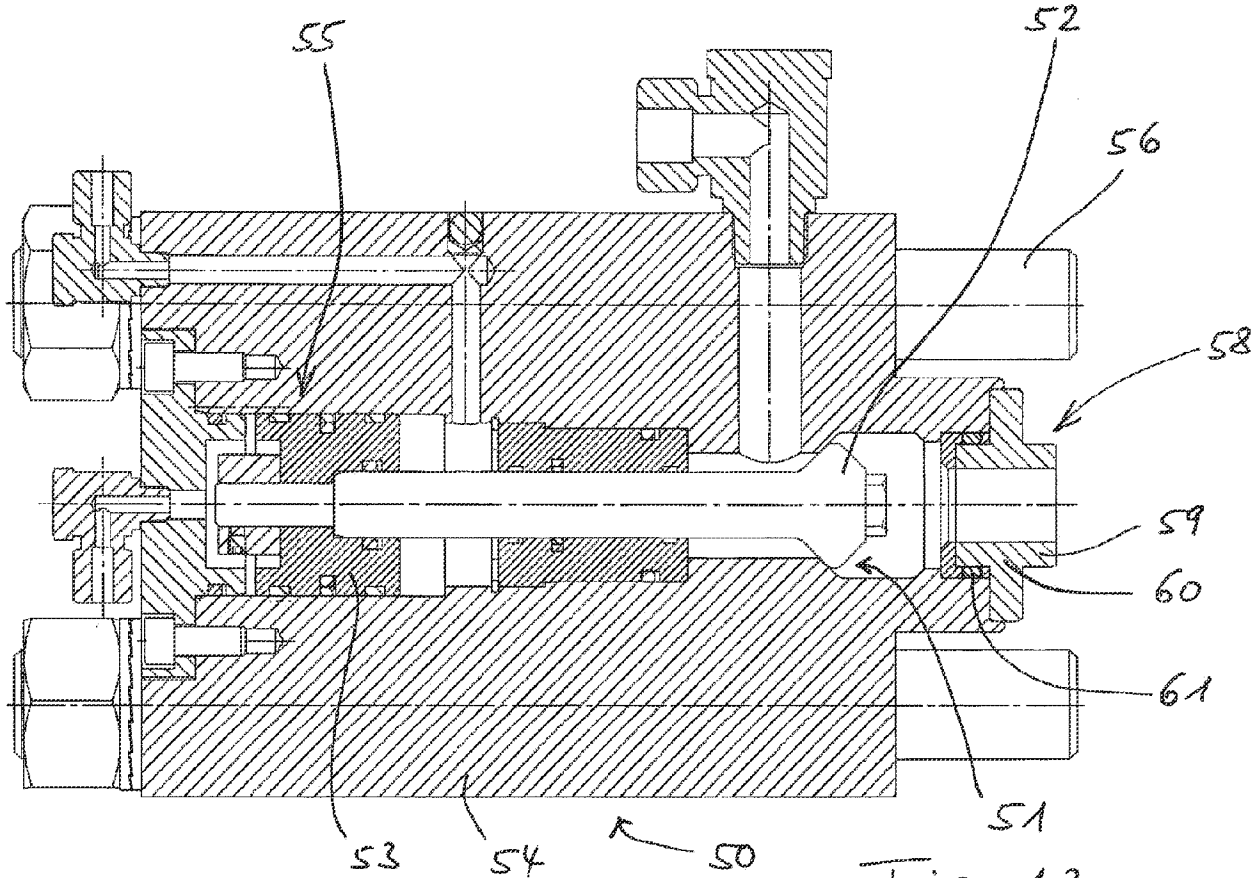
FIG. 12 shows the valve unit used in the radial press according to FIGS. 1 to 11 in an enlarged diagram.

Lower frame component 4 and the two side plates 3 engage positively with one another via profilings 15 corresponding substantially to one another (see FIG. 11). These profilings 15 are configured such that lower frame component 4 and each of the two side plates 3 respectively bear on one another in a manner that transmits force in working direction not only on a load surface 16 oriented substantially perpendicular to working direction B, but also on at least one bracing face 17 offset therefrom and disposed more or less perpendicularly on load surface 16. These cooperating bracing faces 17 ensure not only that the engagement of side plates 3 and lower frame component 4 remains preserved, but relative to the respective associated load surface 16 these bracing faces 17 additionally impose respective bracing torques C, which counteract deformation of side plates 3 during press action. Starting from the respective load surface 16, and avoiding overly large discontinuities, profiling 15 of side plates 3 follows an ellipse E with adjoining transition chamfers S in the direction of the full wall thickness (i.e. upward in FIG. 11).

Furthermore, two interlocking members 18, which are guided displaceably on upper clamp 5 of frame structure 2 along linear guides 19 oriented transversely relative to working direction B, are disposed between the two side plates 3 on both sides of guide console 13. By means of hydraulic traveling cylinder 20, these two interlocking members 18 (which are coupled with one another) can be pushed at the same time, i.e. synchronously, into an interlocked position lying above upper yoke 10 when the upper yoke is lowered by a corresponding distance (see hereinafter) by means of associated first hydraulic piston-cylinder unit 21. Thus upper yoke 10 can be mechanically interlocked relative to frame structure 2 by means of the two positionally variable interlocking members 18 in the sense that the force directed substantially upwardly in working direction B and exerted (during press action) by lower yoke 11 via workpiece 1 on upper yoke 10 is introduced via the two interlocking members 18 into side plates 3. For this purpose upper yoke 10 bears in the region of upper end faces 22 on corresponding contact faces 23 of the two interlocking members 18; and the two interlocking members 18 engage—at least in their interlocked position—via lateral profilings 24 in corresponding profilings 25 of side plates 3. The said profilings 24 and 25 of interlocking members 18 and of associated side plate 3 in question then bear respectively on one another at a load surface 26 disposed substantially perpendicular to working direction B. Furthermore, the two side plates 3 are braced at the top, via a bracing face 27 disposed in perpendicular relationship on load surface 26, against clamp 5; and the two interlocking members 18 are braced in addition to this at the bottom inside against bracing faces 28, which are provided on both sides on a bar 29 disposed at the top side of upper yoke 10.

The radial press is further provided with a hydraulic drive system, which acts on upper yoke 10 as well as lower yoke 11. This drive system comprises a first drive unit 75 in the form of a first hydraulic piston-cylinder unit 21 associated with upper yoke 10 and urging its movement relative to lower yoke 11 (and therefore relative to the frame structure), a second drive unit 76 in the form of three second hydraulic piston-cylinder units 30 associated with lower yoke 11 and urging its movement relative to frame structure 2, a hydraulic assembly 31 pressurizing hydraulic piston-cylinder units 21, 30 and valves controlling the said pressurization. These valves—which can be activated by the press controller—are mounted in two valve and distribution blocks 32 and 33. Compared with first piston-cylinder unit 21, which is constructed to move upper yoke 10 downward as well as upward by double action and the lower end of which is stopped against lower yoke 11, the three second piston-cylinder units 30 are single-acting units, wherein two press-action units 34 and one return-movement unit 35 disposed between these are provided. These cylinders 36 of the three second piston-cylinder units 30 are constructed respectively in lower frame component 4; and pistons 37 of the three second piston-cylinder units 30 are joined to a mounting plate 38 for lower yoke 11. In this way some flexibility (especially in the form of an elastomeric element) is interposed in the region of the joint of the piston of return-movement unit 35 to mounting plate 38, so that deformations occurring—within certain limits—during operation of the press cannot lead to seizing. For the same reason, the pistons of press-action units 34 are constructed in "articulated" manner, in the sense that certain tilting movements of the pistons in the associated cylinders are tolerated and do not impair operational safety. In the middle plane defined by press axis A, mounting plate 38 is otherwise guided by two guide studs X, which are joined—again in flexible relationship—to mounting plate 38 and are received slidingly in corresponding guide bores of lower frame component 4. Lower yoke 11 is braced non-coercively against mounting plate 38 in the sense that it can be displaced sideways, i.e. transversely relative to working direction B, on the surface of mounting plate 38. For this purpose the surface of mounting plate 38 is constructed as roller track 39.

Furthermore, cylinder 40 on the high-pressure side of a hydraulic differential pressure booster 41 is mounted—oriented at right angles to working direction B—in lower frame component 4, i.e. in the present case is constructed directly in lower frame component 4. Piston 42 on the low-pressure side of hydraulic differential pressure booster 41 is guided sealingly—by means of a bolted flange 43—in a cylinder housing 44 flanged onto lower frame component 4. A round stiffening plate 45, which bears with its circumferential rim on the inside of threaded projection 46 of cylinder housing 44, is disposed in the region of bolted flange 43 of cylinder housing 44. Cylinder 40 on the high-pressure side of hydraulic pressure booster 41 communicates via a connecting duct 47 directly with cylinders 36—connected in parallel with one another via duct 57—of the two press-action units 34, which in this way represent high-pressure units 48.

Cylinders 36 of the two high-pressure units 48 communicate with a further feed line 49, via which high-pressure units 48 can be pressurized—during the first part of the press-action process, in other words "precompression", until press jaws 12 bear against or encounter considerable resistance due to workpiece 1—by hydraulic assembly 31 while bypassing hydraulic pressure booster 41. A filling valve 50, which has a shutoff function resistant to high pressure and in the present case has the form of a check valve 51 designed, for example, for 3,000 bar, is connected in second feed line 49 between hydraulic assembly 31 and high-pressure units 48. In this respect, filling valve 50 actually represents a filling and shut-off valve. This filling valve 50 is constructed as a poppet valve with a hydraulically actuatable closing member 52, which is in communication with an actuating piston 53, which in turn is part of hydraulic piston-cylinder unit 55 mounted in housing 54 of filling valve 50. Hydraulic piston-cylinder unit 55, which serves to actuate closing member 52 of filling valve 50, is also pressurized—via pilot valves mounted in valve and distribution block 32—from hydraulic assembly 31 via pressure regulator 73 and valve and distribution block 33.

Valve housing 54 of filling valve 50 is attached by means of preloaded expansion bolts 56 to frame structure 2 of the forming press. Sealing of valve housing 54 against frame structure 2 is achieved in this case (on both sides) in the region of outer circumferential surface 58 of a sleeve-like projection 59 of an adapter 60, which is disposed on valve housing 54 and on which an O-ring 61 rests. In this way, reliable leak-tightness is assured even in the presence of a certain play, which is unavoidable under the action of the highest pressures on closing member 52 and expansions of expansion bolts 56 caused hereby.

The hydraulic drive system is further designed and set up so that temperature regulation of the hydraulic fluid and/or of the press can be integrated. In order to permit the hydraulic fluid to circulate inside the radial press for this purpose, piston rod 62 of hydraulic pressure booster 41 has a longitudinal bore 63, which at the end face, i.e. in the region of piston 64 on the high-pressure side, is bounded in the present case by a check valve 65 designed for 3,000 bar. At the opposite end, longitudinal bore 63 communicates via a connecting bore 66 with piston-rod working chamber 67 of hydraulic pressure booster 41. Furthermore, check valves 68, which open for a flow direction from piston-rod working chamber 67 of hydraulic pressure booster 41 to its piston working chamber 69 are also provided in piston 42 on the low-pressure side of hydraulic pressure booster 41. Other flow or hydraulic-oil circulation concepts that can be used for temperature regulation of the press or of the hydraulic oil are possible in corresponding manners.

Figure 13:
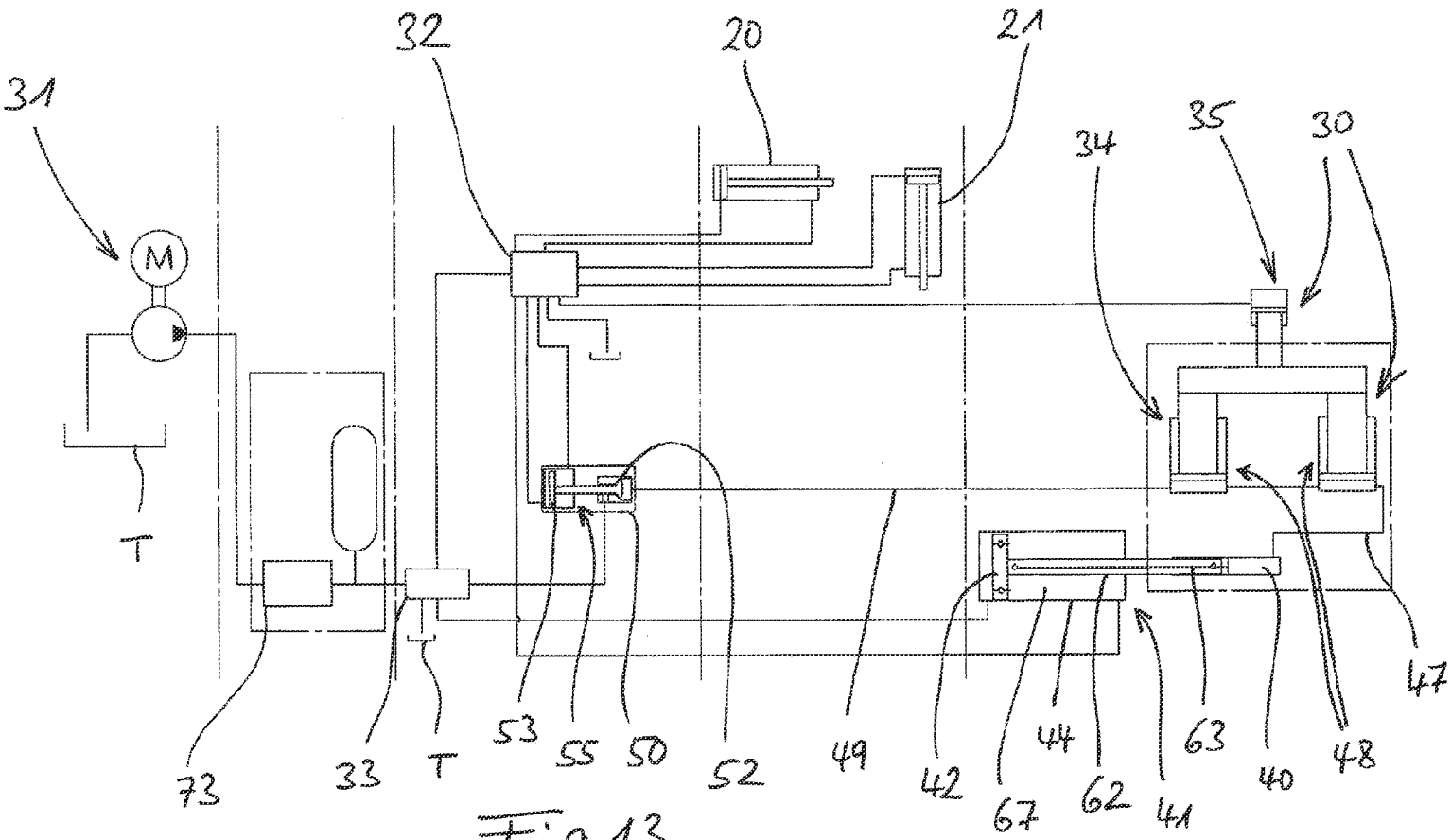
FIG. 13 shows a hydraulic circuit diagram of the radial press according to FIGS. 1 to 12.

The mode of operation of the illustrated radial press is as follows (see FIGS. 1-9):

In FIG. 1, the press is ready for insertion of workpiece 1 to be pressed (see FIG. 1). The movable parts, i.e. in particular lower yoke 11, upper yoke 10, interlocking members 18 and the piston unit of hydraulic pressure booster 41 occupy their home or starting position. If temperature regulation of the press and/or of the hydraulic fluid is required, the latter is able to circulate during this phase. As an example for this purpose (see FIG. 13), hydraulic fluid injected by hydraulic assembly 31—via pressure regulator 73, distribution and valve block 33 and valve and distribution block 32—into piston-rod working chamber 67 of hydraulic pressure booster 41 flows from there on the one hand—via connecting bore 66 and longitudinal bore 63 of piston rod 62 as well as cylinder 40 on the high-pressure side of hydraulic pressure booster 41—out of cylinders 36 of high pressure units 48 and flows via filling valve 50—which is opened for this purpose—to valve and distribution block 33 and from there back into tank T; on the other hand, hydraulic fluid injected into piston-rod working chamber 67 of hydraulic pressure booster 41 flows via check valves 68 disposed in piston 42 on the low-pressure side of hydraulic pressure booster 41, piston working chamber 69 and valve and distribution block 33 back into tank T.

Figure 2:
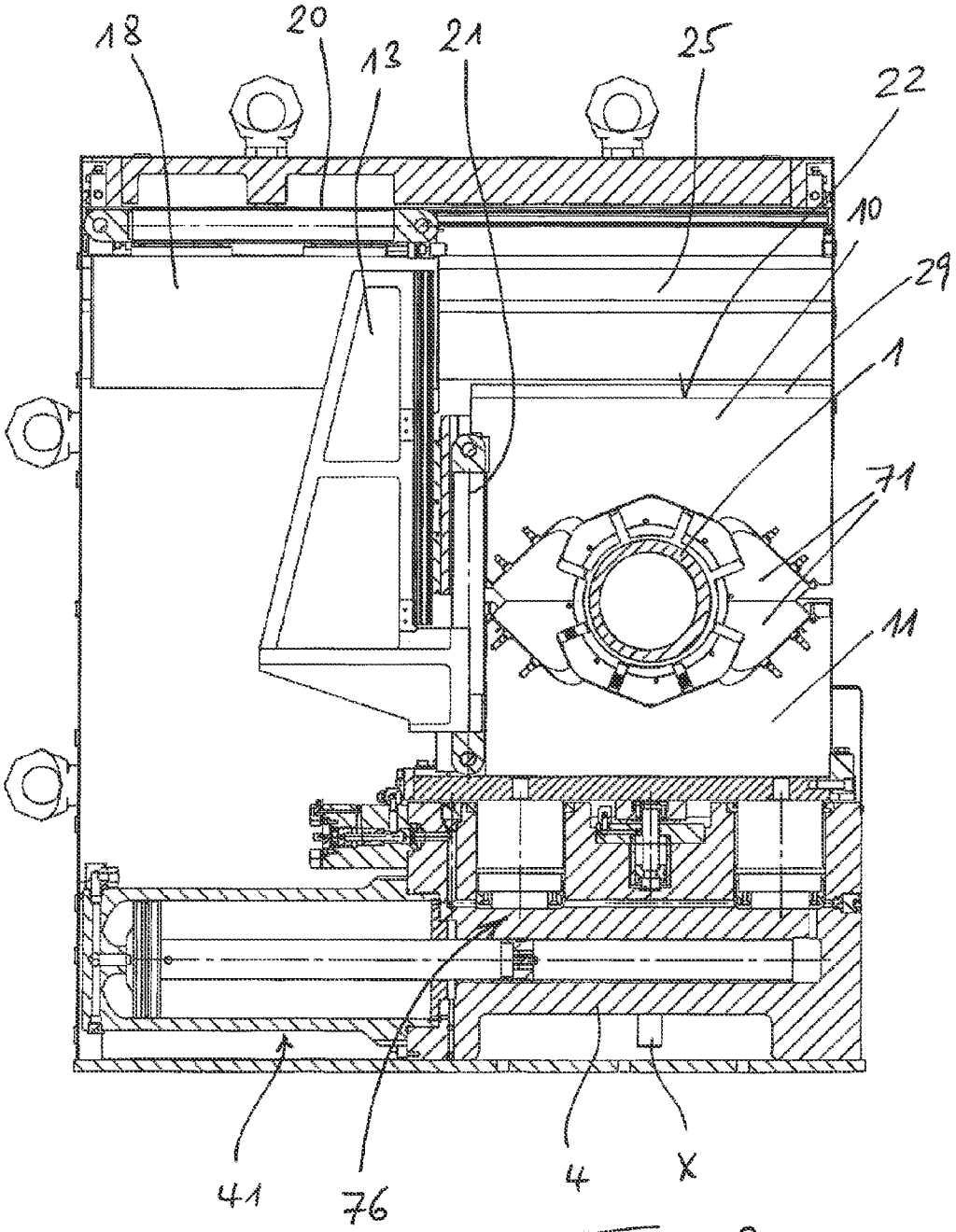
FIG. 2 shows the radial press according to FIG. 1 with closed die, i.e. completely lowered upper die carrier.
Figure 3:
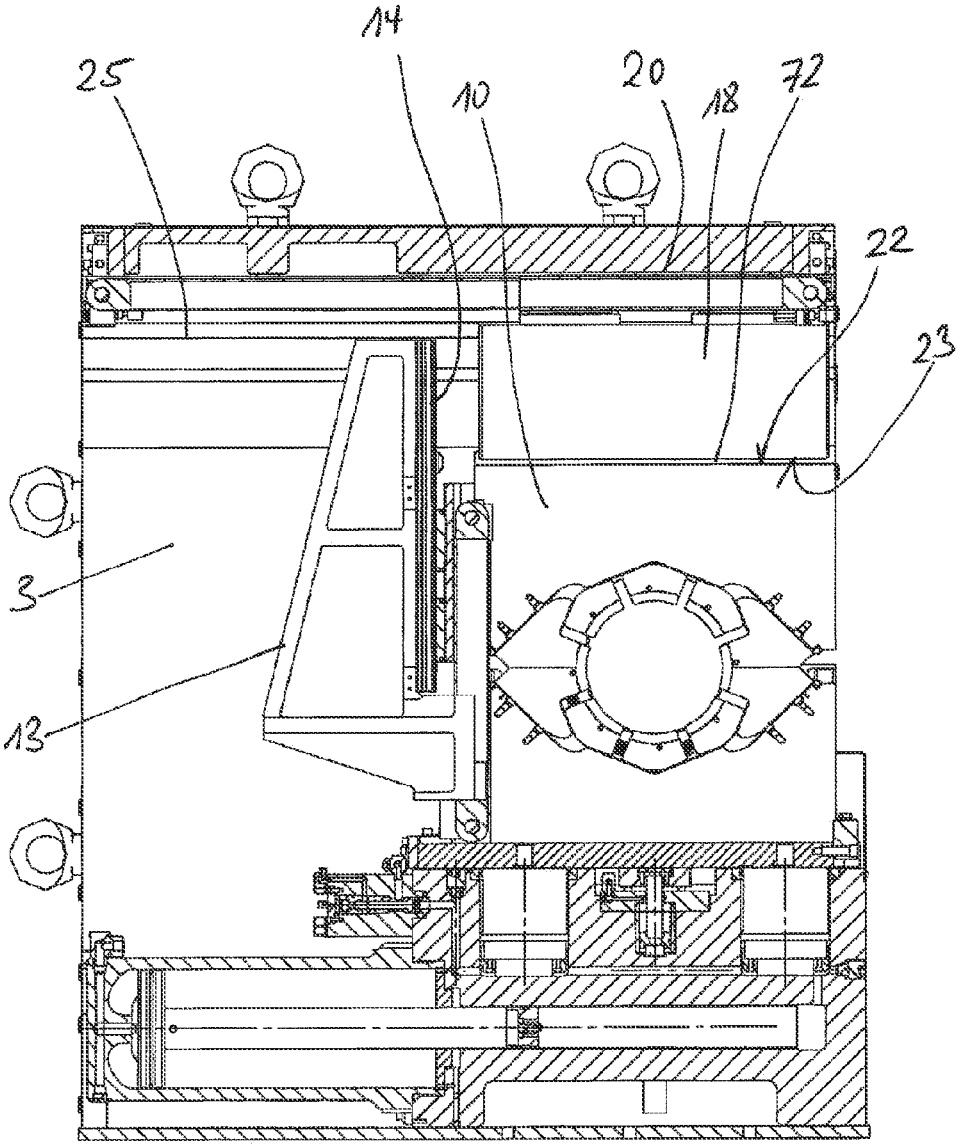
FIG. 3 shows the radial press according to FIGS. 1 and 2 with mechanically interlocked upper die carrier.
Figure 4:
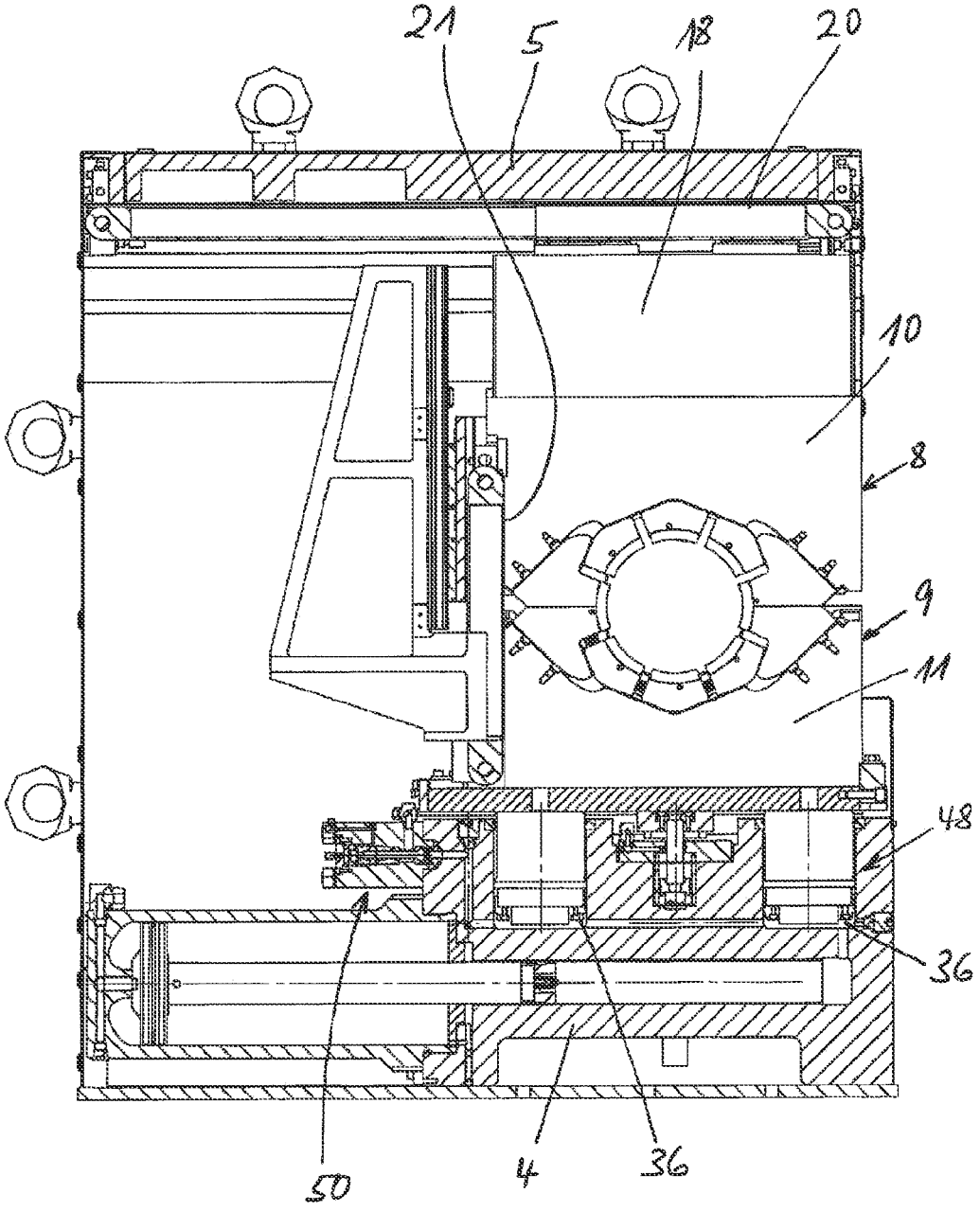
FIG. 4 shows the radial press according to FIGS. 1 to 3 after a first part of the upward movement of the lower die carrier.
Figure 5:
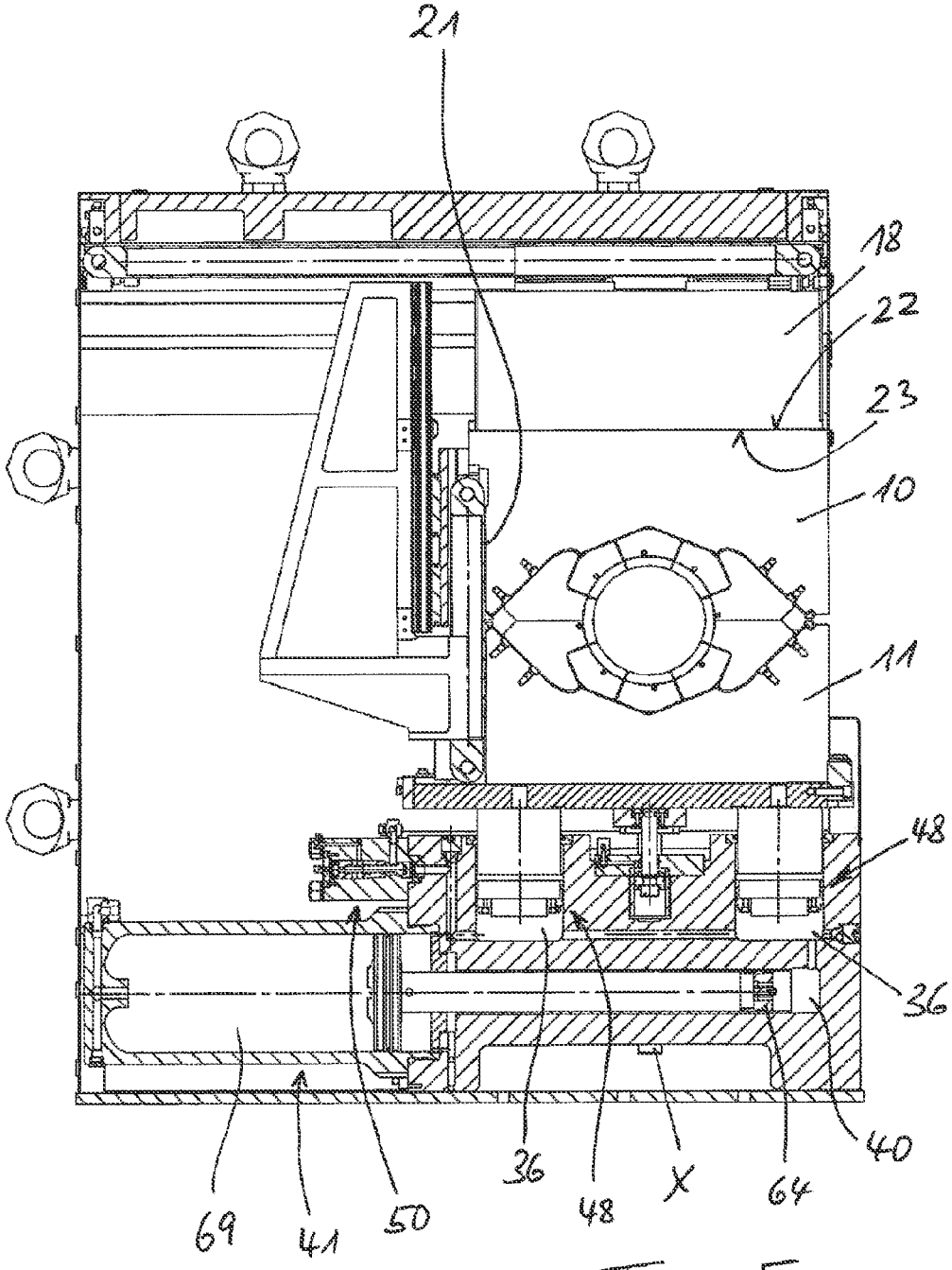
FIG. 5 shows the radial press according to FIGS. 1 to 4 with lower die carrier moved completely upward, i.e. at the end of the press-action process.
Figure 6:
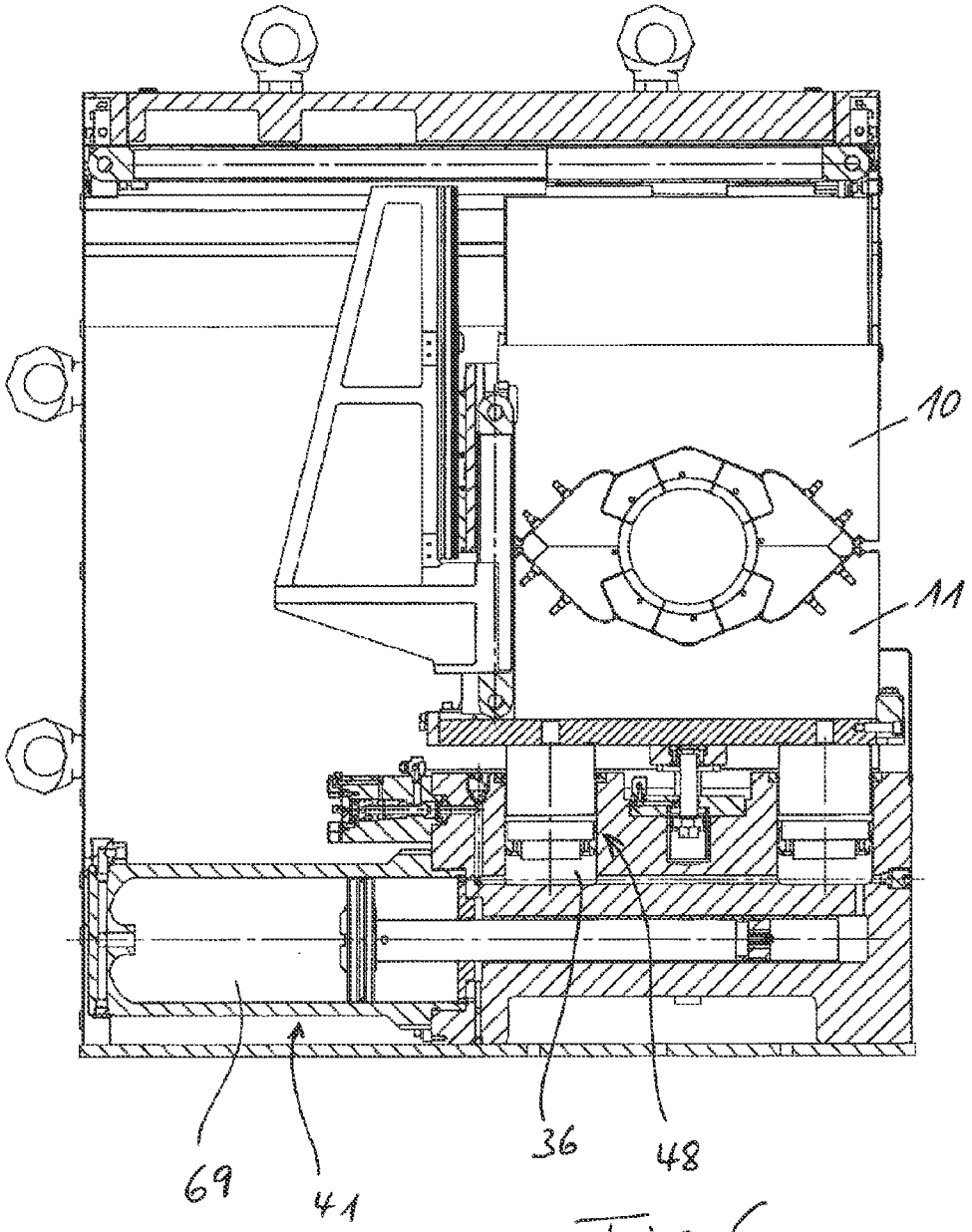
FIG. 6 shows the radial press according to FIGS. 1 to 5 at the end of the decompression phase.
Figure 7:
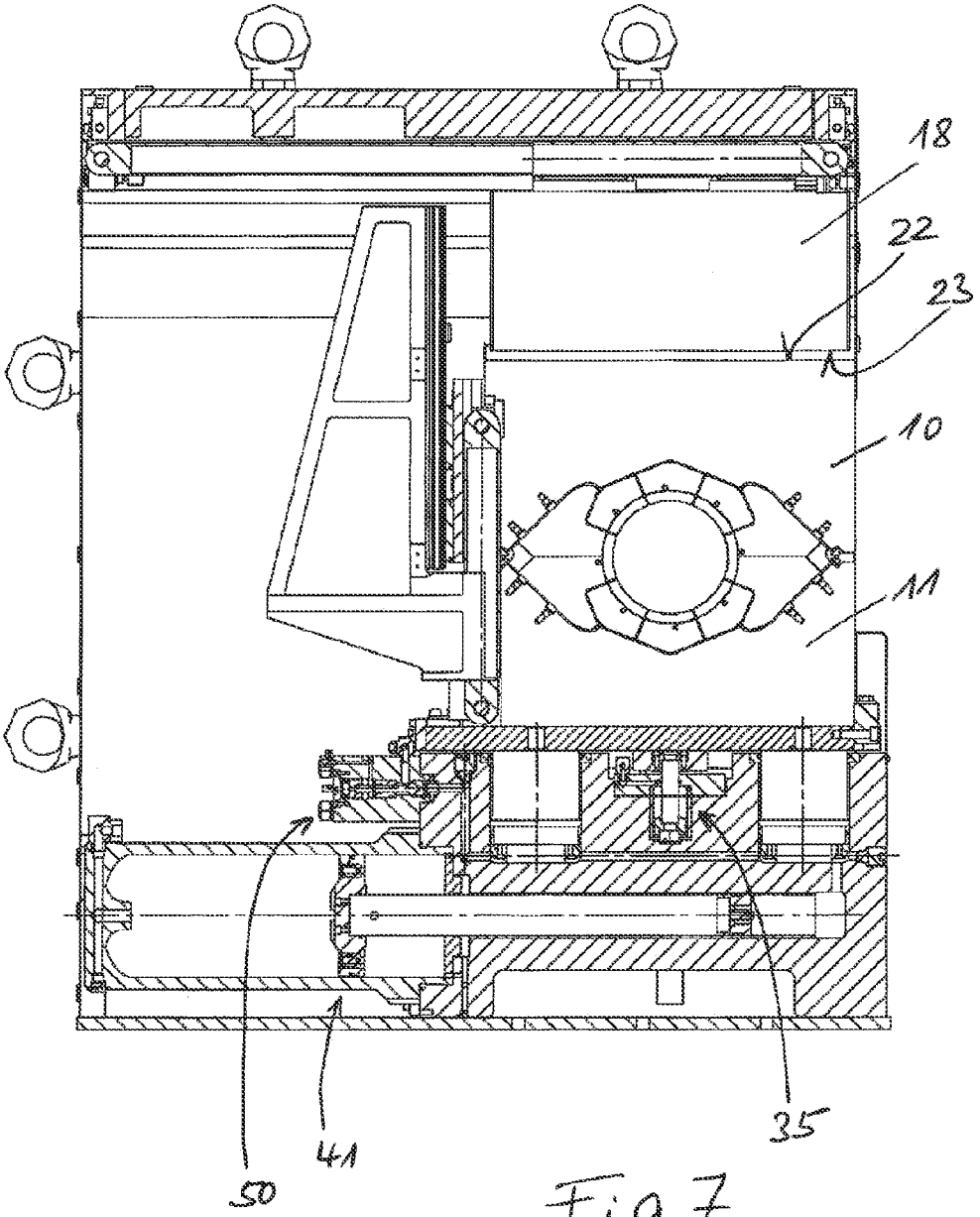
FIG. 7 shows the radial press according to FIGS. 1 to 6 after complete lowering of the lower die carrier.
Figure 8:
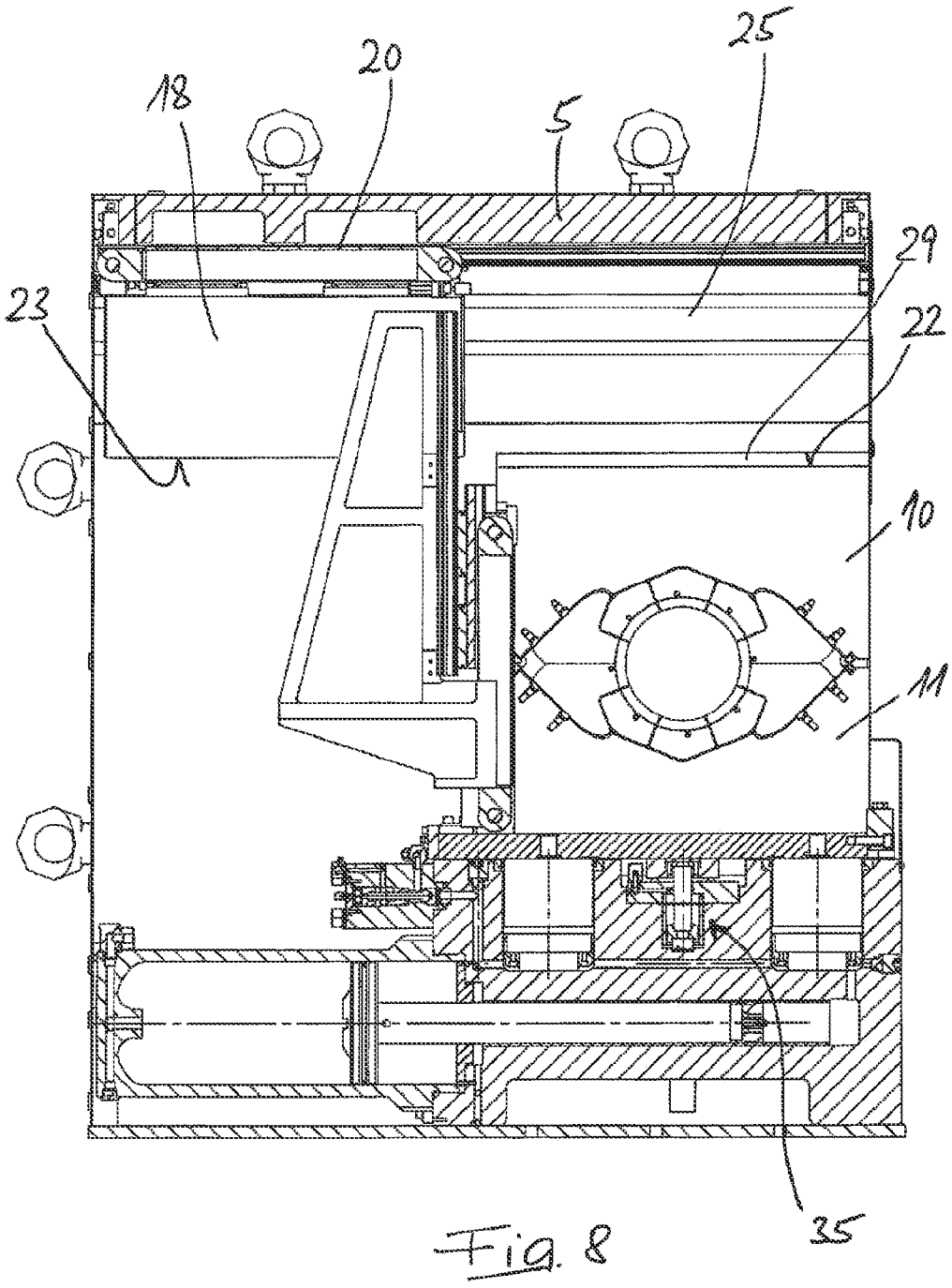
FIG. 8 shows the radial press according to FIGS. 1 to 7 after unlocking of the upper die carrier.
Figure 9:
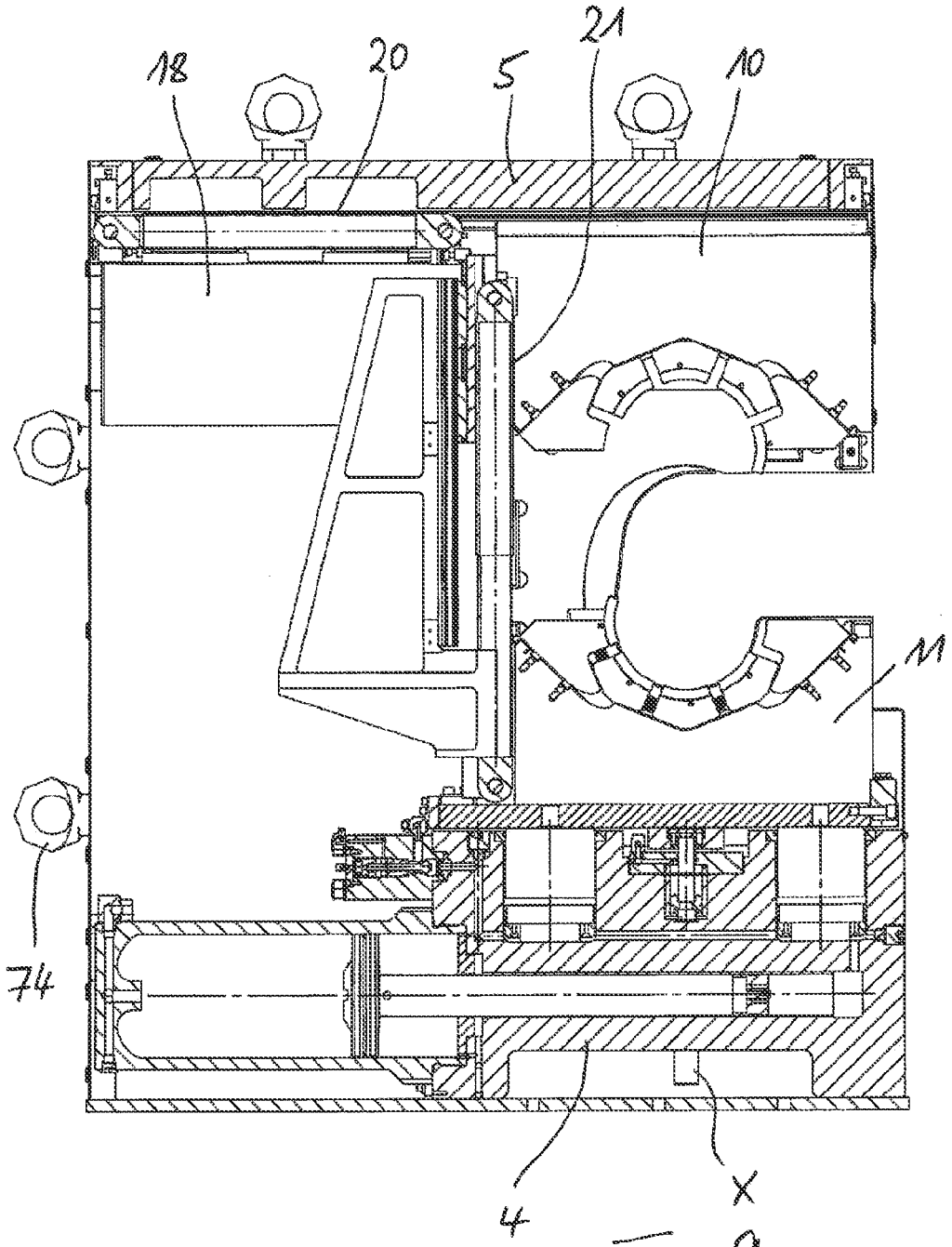
FIG. 9 shows the radial press according to FIGS. 1 to 8 after complete raising of the upper die carrier; furthermore.
Figure 10:
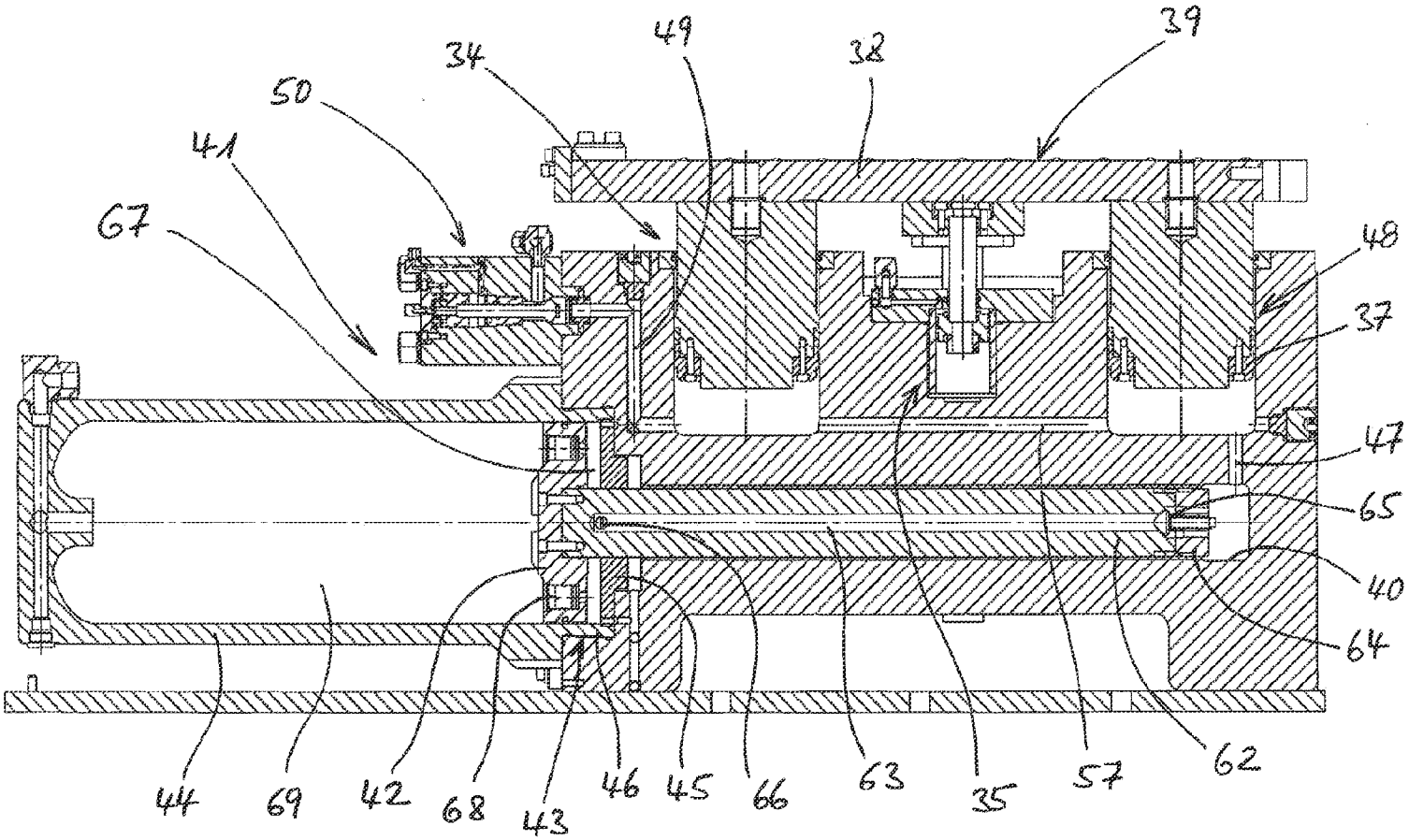
FIG. 10 shows an enlarged vertical section through the part of the drive unit associated with the lower die carrier.

For radial deformation of workpiece 1 disposed in receiving chamber 70 of the press, first hydraulic piston-cylinder unit 21 is pressurized by hydraulic assembly 31 via valve and distribution blocks 33 and 32 in the sense that upper yoke 10 is moved downward toward lower yoke 11, and specifically until the die closes, i.e. until press jaw portions 71 of the split press jaws associated with the two component dies are stopped against one another (see FIG. 2). In this position, the press jaw system is in the closed condition, ready for the actual press-action process.

Now (see FIG. 3) the hydraulic piston-cylinder unit used for moving the two interlocking members 18 (i.e. traveling cylinder 20) is pressurized by hydraulic assembly 31 via valve and distribution blocks 33 and 32 in the sense that the two interlocking members 18 are pushed via upper yoke 10. In this phase a small gap 72 is present between upper end faces 22 of upper yoke 10 and corresponding contact faces 23 of the two interlocking members 18. This gap 72 permits the said displacement movement of interlocking members 18 via upper yoke 10 regardless of the fact that such displacement is blocked via cooperating latching elements when upper yoke 10 in raised position is bearing on interlocking members 18.

In the next step (see FIG. 4), cylinders 36 of the two high-pressure units 48 are pressurized by hydraulic assembly 31 via valve and distribution block 33 and opened filling valve 50 in the sense that lower yoke 11 is raised, and specifically until the press-jaw system brought further together bears on workpiece 1 ("precompression") and the die-carrier unit (together with the die received therein) comprising first die carrier 8 and second die carrier 9 is raised until upper yoke 10 bears on the two interlocking members 18 in the region of the faces corresponding to one another. In this phase, first piston-cylinder unit 21 is switched to its floating position. A pressure sensor (or pressure-operated switch)—in communication with the press controller—measures the (abrupt) pressure rise established hereby in the hydraulic drive system and trips changeover from pressurization of high-pressure units 48 via filling valve 50 and further feed line 49 to pressurization of high-pressure units 48 via hydraulic pressure booster 41. For this purpose, filling valve 50 is closed by corresponding pressurization of piston-cylinder unit 55 of hydraulic assembly 31 associated with closing member 52 via valve and distribution blocks 33 and 32.

Thereafter (see FIG. 5), by virtue of pressurization of piston working chamber 69 of hydraulic pressure booster 41 by hydraulic assembly 31 via valve and distribution block 33, hydraulic fluid is forced into cylinders 36 of high-pressure units 48 under high pressure from cylinder 40 of hydraulic pressure booster 41 by its piston 64 on the high-pressure side. This is the process of actual high-pressure power-pressing. This high-pressure power-pressing is sustained until the pressed dimension is achieved. In this phase also, first piston-cylinder unit 21 is switched to its floating position.

The press action (see FIG. 6) is followed by a decompression phase, in order to relieve the hydraulic fluid, which has been compressed under the existing extreme pressure conditions (e.g. compressed at 3,000 bar to approximately 80% of the starting volume), at least substantially to the pressure level of incompressibility or even more extensively (to more or less the tank pressure). This relief of the hydraulic fluid pressurized on the high-pressure side takes place by a controlled movement (via the relevant valves of valve and distribution blocks 33 and 32) of the piston unit of hydraulic pressure booster 41.

Thereupon (see FIG. 7)—by appropriate activation of the valves of valve and distribution blocks 32 and 33—the hydraulic fluid present on the low-pressure side of hydraulic pressure booster 41 is blocked, whereby the piston unit of hydraulic pressure booster 41 is shut off, filling valve 50 is opened and return-movement unit 35 is pressurized from hydraulic assembly 31. Hereby lower yoke 11 is moved downward, and specifically until it occupies the position in which it is lowered to the maximum extent ("starting position" according to FIG. 1). Upper yoke 10 follows it because of its dead weight, and so this separates from interlocking members 18, thus releasing the two interlocking members 18. During this phase, hydraulic fluid from high-pressure units 48 are forced via filling valve 50 into tank T. In order to support the mutual lowering of the entire die-carrier unit, which continues to be closed, first piston-cylinder unit 21 can be shut off if necessary in this phase.

Next (see FIG. 8), the two interlocking members 18 are moved into their starting or home position by appropriate pressurization of traveling unit 20, so that (see FIG. 9) the die is then opened—by pressurization of first piston-cylinder unit 21—and upper yoke 10 is moved further upward, and specifically until it reaches the home position. The finish-pressed workpiece can be removed from the opened die. The return movement of the piston unit of hydraulic pressure booster 41 to its starting position completes the cycle; for this purpose, the high-pressure side of hydraulic pressure booster 41 is pressurized—while the pressurization of return-movement unit 35 is maintained and the associated valves are appropriately activated—from hydraulic assembly 31 via filling valve 50 and cylinders 36 of high-pressure units 48. Hydraulic fluid from piston working chamber 69 of hydraulic pressure booster 41 is then forced via valve block 33 into tank T. Nevertheless, this return movement of the piston unit of hydraulic pressure booster 41 can also be initiated earlier, namely as soon as lower yoke 11 is lowered into its starting position (see hereinabove).

It will be noted that FIG. 11 has schematic character. Thus the radial press is illustrated in a form simplified in various aspects. In particular, high-pressure unit 48 and the bracing of lower yoke 11 are illustrated in greatly simplified form.

Figure 14:
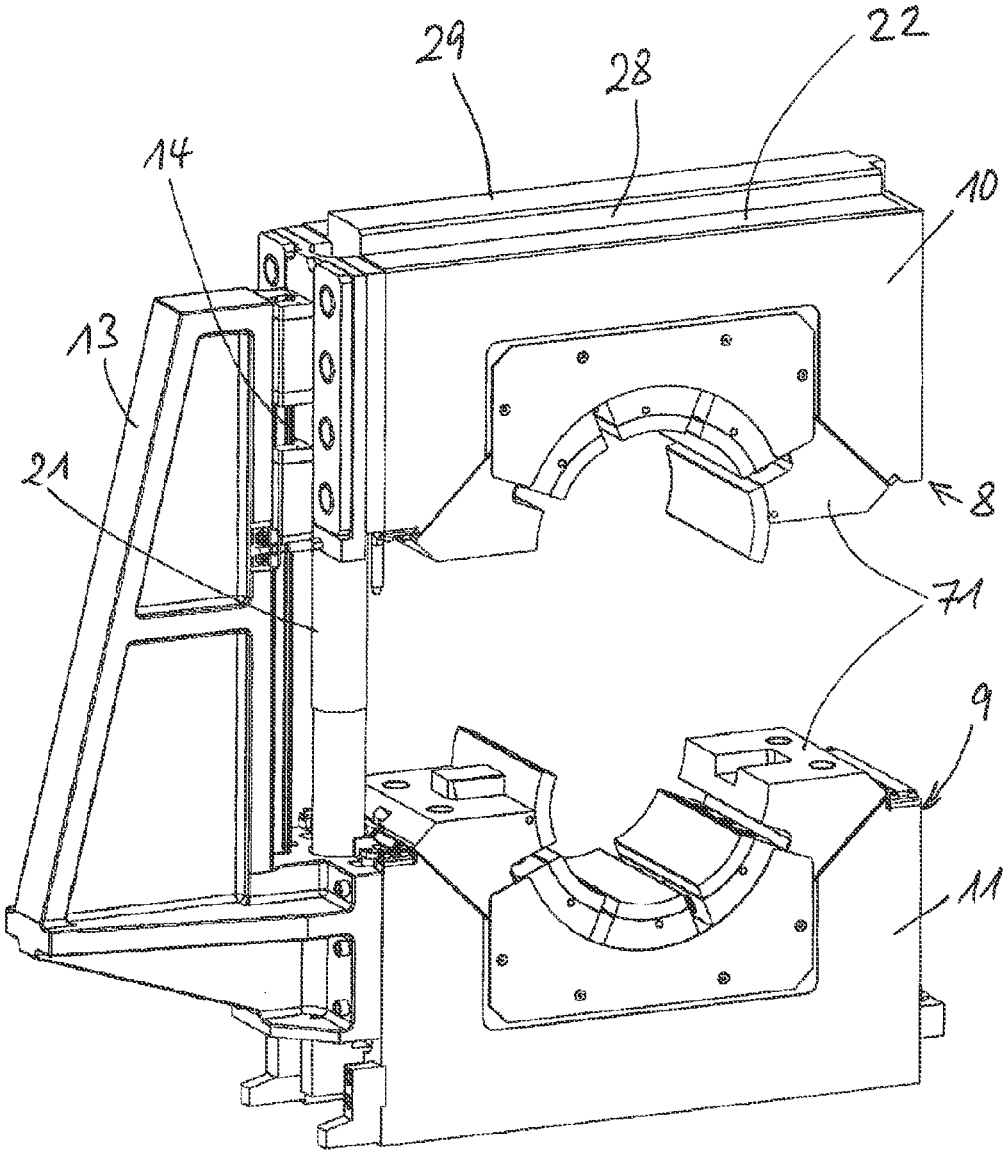
FIG. 14 shows a die-carrier unit removed from the radial press according to FIGS. 1 to 9 together with inserted radial press die.

FIG. 14 illustrates the possibility of removing the entire unit consisting of first die carrier 8 or upper yoke 10, second die carrier 9 or lower yoke 11, guide console 13 fixed to the lower yoke and first piston-cylinder unit 21 (together with press-action die received between the two die carriers), which extends between lower yoke 11 and upper yoke 10, from the frame structure of the radial press, for example in order to refit the press for a different press task. Removal from the press of the unit to be removed as well as positioning of the unit to be received in the press is facilitated at this time by the fact that roller track 39 is disposed on mounting plate 38.

Finally, as a precaution, it is pointed out that the directional indications used, such as "up", "down" and the like are not to be construed in the sense that hereby a certain orientation of the press while in use is intended. To the contrary, the press may also be used in hanging orientation with downwardly directed opening for "sideways" insertion of a workpiece (see suspension eyes 74), as is the case, for example, for joining pipe segments of a fluid line laid on the ground (for example, a pipeline), in which case working direction B runs not vertically but instead horizontally. In this respect the said directional indications must be understood exclusively as related to the orientation of the radial press shown specifically in the drawing. Otherwise, it must be pointed out as a precaution that individual figures may differ from one another with respect to specific details, which are nevertheless completely irrelevant for the nature of the present invention specified in the claims. Since such discrepancies do not affect the invention as such, they are immaterial and therefore need no comment.

What is claimed is:

1. A fluidic forming press comprising: a frame structure, with a first die carrier (8) capable of moving relative to the frame structure along a working direction (B), with a second die carrier (9) capable of moving relative to the frame structure along the working direction (B), with a drive system, which acts on the first and second die carriers and which comprises a first drive unit (75) associated with the first die carrier (8) and a second drive unit (76) associated with the second die carrier (9) with at least one fluidic cylinder-piston unit (30), at least one pressurized-fluid assembly pressurizing at least the latter, and with a press controller that controls the drive system, with the following features:

the at least one first drive unit (75) associated with the first die carrier (8) is constructed as a fast-stroke unit, by means of which the first die carrier (8) can be moved between a home position relatively distant from the second die carrier (9) and a closed position relatively close to the second die carrier;

in its closed position, the first die carrier (8) can be mechanically interlocked relative to the frame structure by means of at least one positionally variable interlocking member (18);

at least one fluidic piston-cylinder unit (30) associated with the second die carrier (9) is constructed as a unit (48) that can exert high pressure at least for part of the movement of the second die carrier toward the first die carrier (8) and that can be operated at an operating pressure substantially greater than the working pressure of the associated pressurized-fluid assembly; and a fluidic pressure booster is integrated into a feed line via which the high-pressure unit (48) is in communication with the associated pressurized-fluid assembly.

2. The forming press of claim 1 further comprising a hydraulic drive system, wherein the first and second drive units (75; 76) comprise hydraulic piston-cylinder units (21; 30), the at least one pressurized-fluid assembly is constructed as a hydraulic assembly (31), a hydraulic pressure booster (41) is provided as the fluidic pressure booster and the at least one first hydraulic piston-cylinder unit (21) associated with the first die carrier (8) is constructed as a low-pressure unit that can be operated at most with the feed pressure of the associated hydraulic assembly (31).

3. The forming press of claim 2, where a cylinder (36) of the at least one high-pressure unit (48) is constructed in a frame component (4), which forms one part of the frame structure and engages via lateral profilings (15) in corresponding profilings (15) of two side plates (3), which also belong to the frame structure.

4. The forming press of claim 3, wherein the profilings (15) of frame component (4) and side plates (3) corresponding to one another are constructed as positive profiles (projections) on the frame component (4) and negative profiles (recesses) on the side plates (3).

5. The forming press of claim 3, wherein, in cross section, the profilings (15) run adjacent to load surfaces (16, 26), at least over a substantial part of an ellipse.

6. The forming press of claim 3, wherein the profilings (15) of the frame component (4) and each of the two side plates (3) respectively bear against one another at a load surface (16) oriented substantially perpendicular to the working direction (B) and at one bracing face (17) at least offset therefrom.

7. The forming press of claim 5, wherein the hydraulic pressure booster (41) is also integrated structurally into the frame structure in such a way that its cylinder (40) is constructed in the frame component (4).

8. The forming press of claim 2, wherein the hydraulic pressure booster (41) is oriented with an axis perpendicular to the working direction (B).

9. The forming press of claim 2 wherein the at least one interlocking member (18) engages at least in its interlocked position via lateral profilings (24) in corresponding profilings (25) of the frame structure.

10. The forming press of claim 9, wherein the profilings (24, 25) of the at least one interlocking member (18) and of the frame structure bear against one another at a load surface (26) oriented substantially perpendicular to the working direction (B).

11. The forming press of claim 2, wherein the at least one interlocking member (18) is capable of being displaced in a direction of movement perpendicular to the working direction (B).

12. The forming press of claim 2, wherein two interlocking members (18) maintaining a distance relative to one another are provided.

13. The forming press of claim 12, wherein a guide console (13) for the first die carrier (8) is provided in the space between the two interlocking members (18).

14. The forming press of claim 13, wherein the first die carrier (8) is guided by means of a linear guide (14) on the guide console (13), wherein the components of the linear guide (14) associated with the first die carrier (8) are joined to the first die carrier via an interposed elastic decoupling unit.

15. The forming press of claim 13, wherein the guide console (13) is firmly joined to the second die carrier (9) and the at least one first hydraulic piston-cylinder unit (21) acts between the first and the second die carriers (8; 9) in such a way that the two die carriers, the guide console and the complete die-carrier unit comprising at least one first hydraulic piston-cylinder unit can be removed from the frame structure.

16. The forming press of claim 2, wherein a further feed line (49) is provided via which the high-pressure unit (48) can be pressurized by an associated hydraulic assembly (31) while bypassing the hydraulic pressure booster (41).

17. The forming press of claim 16, wherein the drive system is provided on the supply side associated with the second die carrier (9) with a pressure sensor or pressure-operated switch in communication with the press controller, wherein a changeover that depends on the pressure signal, from pressurization of the high-pressure unit (48) via the second feed line (49) to pressurization of the high-pressure unit via the hydraulic pressure booster (41), takes place during the movement of the second die carrier (9) toward the first die carrier (8).

18. The forming press of claim 16, wherein a filling valve (50) with a shutoff function resistant to high pressure is connected in the second feed line (49).

19. The forming press of claim 18, wherein the filling valve (50) is constructed as a poppet valve with a hydraulically actuatable closing member (52), which is in communication with an actuating piston (53), which in turn is part of a hydraulic piston-cylinder unit (55) mounted in a valve housing (54) of the filling valve (50).

20. The forming press of claim 18, wherein the filling valve (50) is provided with a valve housing (54) attached to the frame structure of the forming press, wherein preloaded expansion bolts (56) are provided for fastening the valve housing and wherein sealing of the valve housing against the frame structure within the range of compensation for play is achieved by means of a radial seal (61).

21. The forming press of claim 2, wherein the at least one high-pressure unit (48) is constructed as a single-acting unit and in that a return-movement unit (35) in the form of a further hydraulic piston-cylinder unit (30) constructed as a low-pressure unit is associated with the second die carrier (9) for its movement away from the first die carrier (8).

22. The forming press of claim 21, wherein two high-pressure units (48) are provided and the low-pressure unit is disposed between them.

23. The forming press of claim 2, wherein the at least one first hydraulic piston-cylinder unit (21) is constructed as a double-acting unit.

24. The forming press of claim 2, wherein all hydraulic piston-cylinder units (21; 30) can be pressurized from precisely one hydraulic assembly (31).

25. The forming press of claim 2, wherein it is constructed as a radial press that can be loaded from the side in such a way that a receiving chamber (70) provided for a workpiece (1) and disposed between the die carriers (8; 9) is accessible via a lateral opening.

* * * * *